United States Patent [19]

Armstrong

[11] Patent Number: 4,472,994

[45] Date of Patent: Sep. 25, 1984

[54] ELECTROMAGNETIC TRANSDUCER SYSTEMS IN STRINGED MUSICAL INSTRUMENTS

[76] Inventor: Ronald S. Armstrong, 555 Miramar, San Francisco, Calif. 94112

[21] Appl. No.: 58,750

[22] Filed: Jul. 18, 1979

[51] Int. Cl.[3] ..... G10H 3/18

[52] U.S. Cl. ..... 84/1.15; 84/1.16

[58] Field of Search ..... 84/1.15, 1.16

[56] References Cited

U.S. PATENT DOCUMENTS

| | | | |
|---|---|---|---|
| 1,915,858 | 6/1933 | Miessner | 84/1.16 |
| 3,297,813 | 1/1967 | Cookerly et al. | 84/1.16 |
| 3,629,483 | 12/1971 | Welch | 84/1.16 |
| 3,962,946 | 6/1976 | Rickard | 84/1.15 |
| 4,035,737 | 7/1977 | Curl | 179/1 A X |

*Primary Examiner*—Stanley J. Witkowski
*Attorney, Agent, or Firm*—David B. Harrison

[57] ABSTRACT

An improved electromagnetic pickup for a stringed musical instrument includes constant magnetic field providing magnets for each of the strings adjustably aligned adjacent to each of the strings at a sound providing region of a frame of the instrument. The aligned magnets generate a magnetic flux strength and orientation for each string tailored to the particular string and its tonal characteristics. A very high frequency preamplifier subsystem having a very low impedance input is connected to the strings through shielded connectors extending to the string anchors and functions to amplify greatly the minute electrical signals induced in the plurality of strings as they vibrate when the instrument is being played.

8 Claims, 9 Drawing Figures

FIG. 1
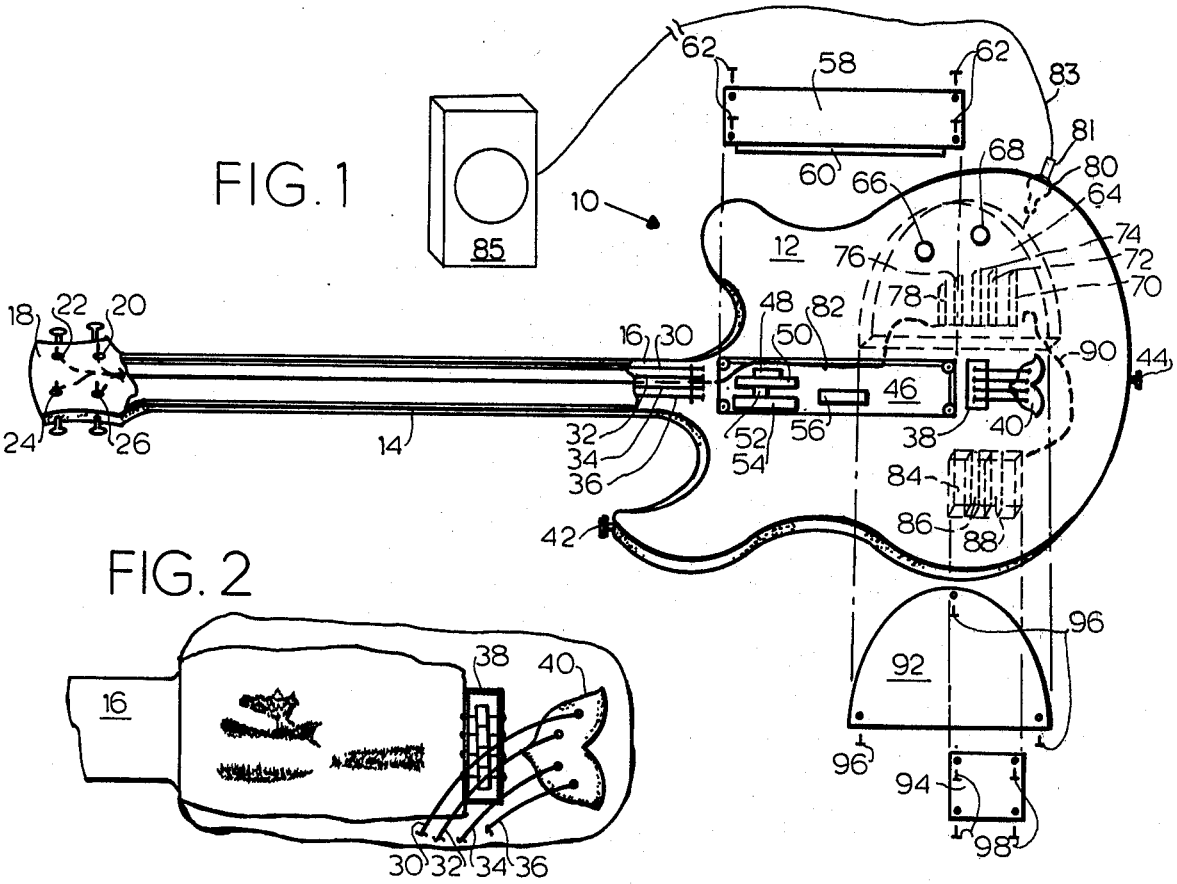
FIG. 2
FIG. 3
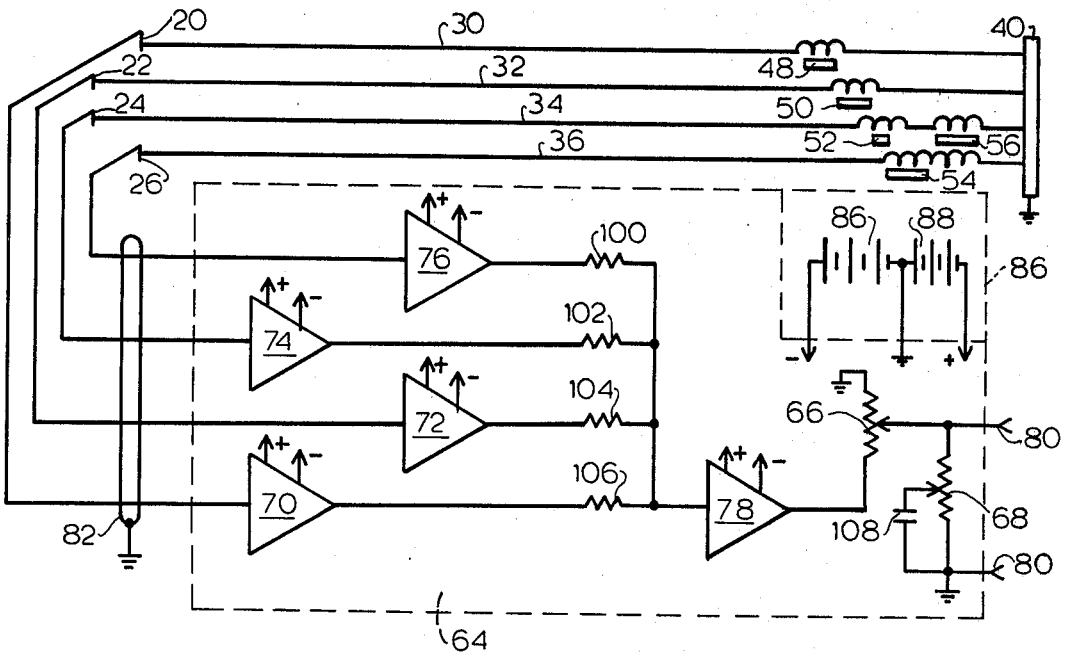

FIG. 4
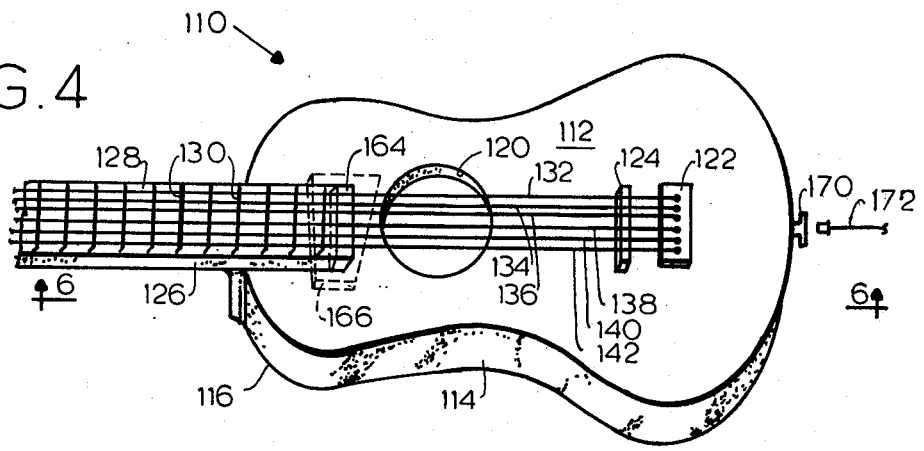
FIG. 6
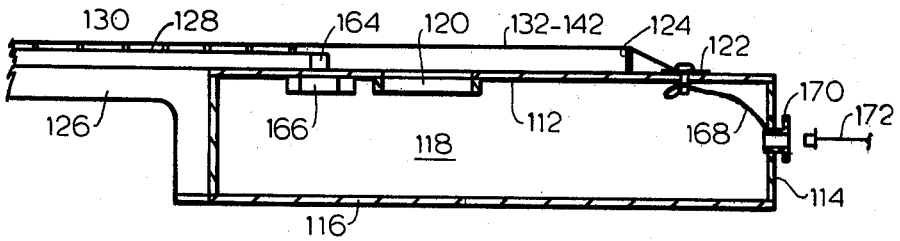
FIG. 7
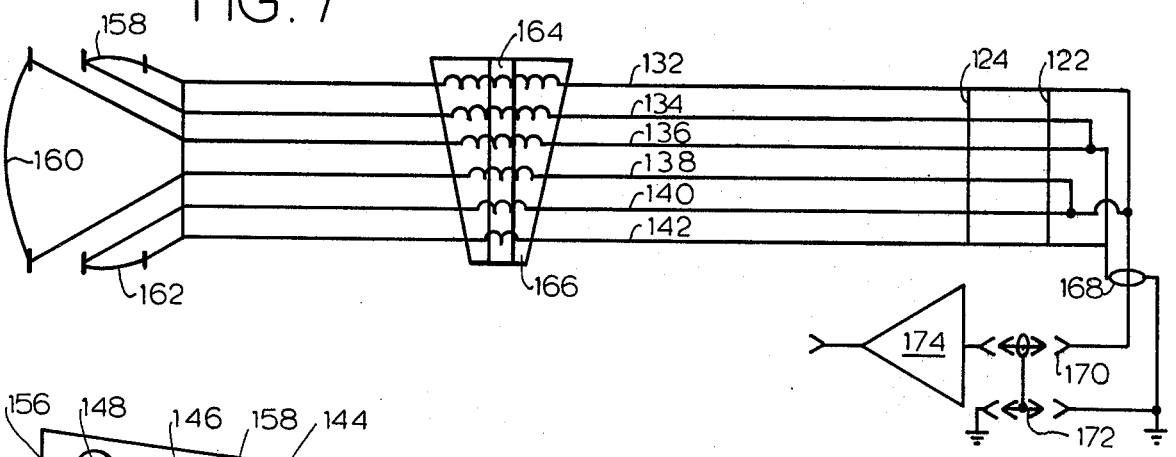
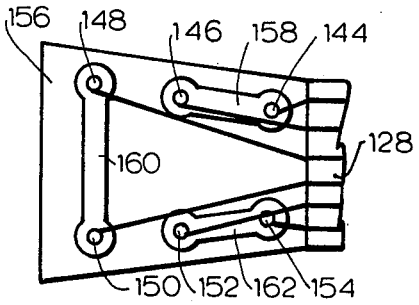
FIG. 5
FIG. 8
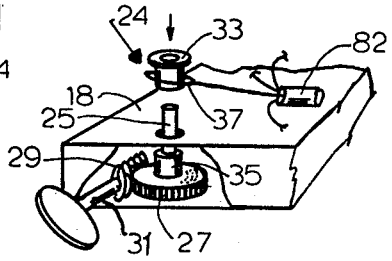
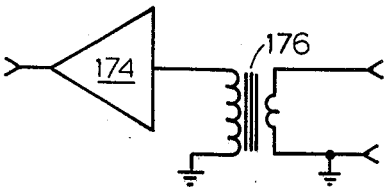
FIG. 7-A

ELECTROMAGNETIC TRANSDUCER SYSTEMS IN STRINGED MUSICAL INSTRUMENTS

BACKGROUND OF THE INVENTION

The present invention relates to electromagnetic pickups for stringed musical instruments. More particularly, the present invention relates to an improved pickup system in which the strings of the instrument function additionally as electromagnetic transducers in magnetic fields which are unique for each string.

The sounds naturally emanating from a stringed musical instrument during play are very complex waveforms, rich with harmonics and other phenomena which combine with the fundamental string tones to produce the tonal quality, personality and distinctiveness which characterizes and define the particular instrument. Many attempts have been made to pick up these tonal characteristics for sound transmission and amplification with a minimum of distortion. One commonly followed indirect pickup approach was to position a high fidelity microphone in close proximity to the sounding board or box of the instrument. A common direct pickup approach was to provide a variable reluctance electromagnetic pickup somewheres adjacent the string or strings. An early teaching of an electromagnetic pickup technique was found in the Meissner U.S. Pat. No. 1,915,858, FIGS. 1–4.

Since at least the Meissner patent disclosure, it has been known in the art to induce an electrical signal directly in a vibrating, electrically conductive string of a musical instrument by providing a magnetic field in the vicinity of the string. During string vibration, as with plucking or strumming a guitar or with hammer strikes of a piano, the vibrating string intersected magnetic lines of force of the field in a way which induced an electrical signal in the string somewhat analogous to the sound waves generated by the musical instrument. One early approach was disclosed in the Meissner patent, referred to above, particularly therein with reference to FIGS. 7 and 8 where the strings functioned as the electromagnetic transducers.

An alleged refinement of the Meissner scheme was described in U.S. Pat. No. 3,297,813 to Cookerly et al issued in 1967. Therein the purported improvement was described and claimed to be the provision of magnetic material of opposed poles lying adjacently perpendicular to the strings for a length thereof more than half the overall string length.

Nowhere in the prior art known to applicant was there a recognition that for faithful tonal pickup and reproduction, the magnetic field must be tailor-made for each string as well as for the characteristics of the player.

With the foregoing in mind, it is an object of the present invention to provide an improved electromagnetic pickup system for a stringed musical instrument in which the strings of the instrument function, in conjunction with uniquely tailored magnetic fields, to provide an electrical signal more closely analogous to the true tonal quality and personality of the stringed instrument than heretofore realized.

Another object of the present invention is to provide an improved pickup system for stringed instruments which may be readily incorporated into existing instruments with a minimum of modification thereto.

Yet another object of the present invention is to provide an improved electromagnetic pickup for stringed instruments in which the strings, their magnetic fields, and the preamplifier system are connected in a way which provides an analog electrical signal which more faithfully reproduces the tonal quality and personality of the instrument than heretofore realized.

One more object of the present invention is to provide an improved electromagnetic pickup for stringed instruments which enables the user or artist to tailor the electrical pickup to the particular style of play or characteristics of strings and to change these characteristics with little difficulty or inconvenience.

A still further object of the present invention is to provide an improved electromagnetic pickup for stringed instruments which is inexpensive to install and adjust from time to time, which requires virtually no maintenance, and which operates reliably over the useful life of the instrument.

An improved electromagnetic pickup for a stringed instrument in accordance with the present invention includes a constant magnetic field providing magnet tailor adjusted for each string and aligned adjacent to each of the strings at a sound providing region of the instrument. Each magnet generates a magnetic flux strength and orientation for each string to transduce the desired tonal characteristics. A very high gain preamplifier having a very low impedance input is connected to the strings via shielded connectors, and it functions to amplify greatly the minute electrical signals induced in the strings when the instrument is being played. The preamplifier may be placed within the instrument or an outboard element. In either event, the principles of the present invention remain the same.

These and other objects, advantages and features of the present invention will be readily understood upon consideration of the following detailed description of preferred embodiments presented in conjunction with the accompanying drawings.

BRIEF DESCRIPTION OF THE DRAWINGS

In the drawings:

FIG. 1 is a plan view of an electronic bass guitar incorporating the present invention in which the fretless finger board is broken away to reveal hidden wiring, a magnet vault cover is removed, covers for electronics and battery compartments on the reverse thereof are removed, and components in the electronics and battery compartments are illustrated in hidden view.

FIG. 2 is diagram of the magnetic field patterns generated in the guitar shown in FIG. 1.

FIG. 3 is a schematic diagram of an equivalent circuit of the guitar depicted in FIG. 1.

FIG. 4 is a plan view of a six string acoustical guitar which has been modified after original manufacture to incorporate the principles of the present invention shown with a part of the neck and finger board broken off.

FIG. 5 is an enlarged view of the tuning peg head of the guitar shown in FIG. 4.

FIG. 6 is a sectional view of the FIG. 4 guitar along the line 6—6.

FIG. 7 is a schematic diagram of an equivalent circuit of the guitar shown in FIG. 4 together with an outboard preamplifier.

FIG. 7-A is an alternative form of outboard preamplifier for the guitar of FIG. 4.

FIG. 8 is an enlarged detail view in perspective of a portion of the tuning peg support head of the guitar shown in FIG. 1, with a portion broken away to reveal details of the worm gear assembly, and with a portion exploded to reveal electrical connnection to the tuning peg.

DETAILED DESCRIPTION OF PREFERRED EMBODIMENTS

An electrical bass guitar 10 which incorporates the principles of the present invention is illustrated in FIGS. 1, 2 and 3. Therein, the guitar 10 is shown to have conventional characteristics including a laminated solid wood body 12, a neck 14 integrally formed with the body 12 and extending away therefrom, a fretless finger board 16 (mostly broken away in FIG. 1) overlying the neck 14, and a tuning peg support head 18 mounted at the far end of the neck 14. The head 18 includes four tuning pegs 20, 22, 24, and 26. While the guitar 10 is shown to be fretless, a fretted finger board could be utilized in practice of the present invention without any drawbacks.

Four half round metal strings 30, 32, 34, and 36 are stretched from the tuning posts 20, 22, 24, and 26, respectively, over the finger board 16 and through an adjustable bridge 38 to an anchor plate 40 on the body 12 behind the bridge 38. The strings are preferably DiDario No. HR-72 half round metal strings. While other strings may well be utilized with the guitar 10, it is important to note that different adjustments of the magnetic fields to be described hereinafter may be required, depending upon the characteristics of the particular strings employed. Strings having a central core of ferrous material, such as drawn steel, seem to work better than other types of conductive strings.

The guitar body 12 also includes shoulder strap anchors 42 and 44 among other conventional features.

As an embodiment of the present invention, the guitar 10 is provided with a magnet vault 46 which may be formed by routing out the front surface of the body 12 as shown in FIG. 1. Permanent magnets 48, 50, 52, 54, and 56 are placed in the vault 46 in any one of an unlimited numberof arrangements which provide a unique magnetic field for each string at the vicinity of the vault 46. These magnets 48, 50, 52, 54, 56 are characterized by the fact that the pole regions are at the major surfaces thereof, so that with the placement of the magnets 48, 50, 52, 54, 56, as shown in FIG. 1, fields are generated adjacent to the strings.

As shown in FIG. 2, strong, polar region magnetic fields are generated in the proximity of each string as it would normally pass over the magnet vault 46. FIG. 2 depicts the arrangement of ferromagnetic filings placed on a piece of paper overlying the vault 46 with the magnets 48, 50, 52, 54 and 56 in the positions shown in FIG. 1. The magnets 48, 50, 52, 54, 56 are preferably formed on a ferroceramic material manufactured by the Dowling Miner Magnet Company, 372 D Bell Marine Keys Blvd., Novato, Calif., and marketed by that firm under the name "Hot Rod Magnet." Other magnetic materials may be used.

The magnets are oriented so that approximately 40 gauss of magnetic field is present at each string, although the exact magnetic field strength will be particularly adjusted to each string in accordance with the principles of the present invention. The actual field strength may be adjusted by the musician from time to time to accommodate string height, string diameter and typical playing action.

The magnet vault 46 being a recess with the body 12 of the guitar 10, a cover plate 58 is provided therefor which may have a laminated wood veneer on its outer surface to match the decoration of the guitar body 12. On the inner surface, the plate 58 may be provided with a resiliently compressible material 60 such as a plastic foam which functions to bear down upon the magnets 48, 50, 52, 54, and 56 and hold them securely in the position in which they have been placed by the artist. Then, the cover 58 is affixed to the body 12 to close the vault 46. The cover 58 may be held in place by any suitable fastening means such as the four corner screws 62 shown in FIG. 1.

Although the strings 30, 32, 34, and 36 are shown disconnected in FIG. 2 to provide an unobstructed view of the magnetic field, it is to be understood that in practice the plate 58 is removable from the body 12 to gain access to the vault 46 without removing the strings from the tuning pegs 20, 22, 24, 26 or from the anchor 40. Thus, the position of the magnets in the vault 46 may be rearranged before or even during a performance, so that different tonal characteristics may be transduced in the strings as the guitar 10 is played.

On the back side of the guitar body 12, a recessed, shield lined compartment 64 provides a suitable housing for preamplifier electronics contained within the guitar 10. Extending from the front face of the body 12 are two potentiometer sound controls: a volume control 66 and a tone control 68. Connections to these controls are made to the preamplifier electronics within the shielded compartment 64. Also within the shielded compartment 64 are four identical high gain preamplifier modules 70, 72, 74, and 76 which are preferably embodied as small, compact printed circuit plug-in modules. Each preamplifier is connected to and adjusted for a particular string and includes an equlization control to facilitate even gain among strings of uneven output. Thus, the amplifier 70 is connected to the string 30, the amplifier 72 is connected to the string 32, the amplifier 74 is connected to the string 34, and the amplifier 76 is connected to the string 36. The outputs of the amplifiers 70, 72, 74, 76 are connected together in parallel through impedance-equalizing resistors 100, 102, 104, 106 (shown in FIG. 3) and thence supplied to the input of a summing amplifier 78, also implemented as a small, compact printed circuit plug-in module contained within the shielded compartment 64. The output from the summing amplifier 78 is connected through the volume control 66 to an output jack 80 which extends from the side of the body 12 of the guitar 10. Connected in parallel across the output line is the tone control 68 which includes a frequency response altering capacitor 108 connected across the wiper thereof (as shown in FIG. 3).

A suitable plug 81 is shown mated with the jack 80 in FIG. 1. A conventional shielded cable 83 extends from the plug 81 to a conventional instrument audio amplifier and loudspeaker 85. The cable 83 is shown to be broken in length in FIG. 1 to denote that in the use of the instrument 10 the cable may be of any suitable length, the amplifier 78 having sufficient gain to overcome length losses in the cable 83.

The amplifiers 70, 72, 74, and 76 have their inputs connected to the strings 30, 32, 34 and 36 via a return line preferably implemented as a shielded cable 82 which runs from the shielded compartment 64 via the magnet vault 46 and a recess in the neck 14 beneath the fingerboard 16 to the tuning pegs 20, 22, 24, and 26. This shielded cable is shown diagrammatically in FIG. 3. The tuning pegs are preferably conductive metallic pegs, gold or otherwise plated or coated to conduct (Schraller #M4SG work well).

Electrical connections to the tuning pegs 20, 22, 24 and 26 may be made many different ways. A preferred interconnection configuration is shown in the detailed view in FIG. 8. Therein, the tuning peg 24 is shown diagrammatically, with a portion of the tuning peg support head broken away and with other parts exploded along the upright axis of the tuning peg. The tuning peg 24 is shown in FIG. 8 to comprise an upright tuning peg shaft 25 around the upper end of which the string 34 is ordinarily anchored. The shaft 25 is axially joined to a gear 27 beneath the head 18. A worm 29 engages the gear 27. The worm 29 is part of a finger nut 31 which extends laterally outward from the peg head 18 and which is rotated by finger manipulation in the conventional manner. The shaft 25 is journalled through the head 18 via two complementary flanged threaded bushings or grommets 33 and 35. An electrical conductor 37 is preferably looped under the upper grommet 33 and secured between the grommet 33 and the head 18. When the peg 24 is in its fully assembled position, the wire 37 may be dressed in a narrow groove or interior passage provided in the peg head 18 so that it is completely hidden from view. The other pegs 20, 22 and 26 are connected to other wires of the cable 82 in the same way.

The body 12 also includes a shielded battery compartment shown in hidden view by the broken lines in FIG. 1. The battery compartment 84 includes two nine volt batteries 86 and 88 which are series connected, with a common node connected to ground to provide a plus and minus voltage supply supplied through a cable 90 to the preamplifiers located in the shielded compartment 64. The power to the preamplifiers may be conveniently switched on and off by suitable switching contacts provided at the output jack 80 and wired in such a way that power is supplied to the preamplifiers from the batteries only when a plug is inserted in the jack 80 incident to use of the instrument. Alternatively, the preamplifiers may be powered from an external AC power supply via a multiconductor cable and suitable matching connectors.

Suitable closures 92 and 94 are provided for the amplifier compartment 64 and battery compartment 84. These covers 92 and 94 may be a suitable sheet metal such as brass and secured to the body 12 by peripheral screws 96 and 98 as shown in FIG. 1. They may be covered with a wood veneer or polished to present a pleasing appearance.

Turning now to the schematic circuit diagram of FIG. 3, the string anchor 40 provides an electrical ground for the four metallic strings. The magnets 48, 50, 52, 54, 56 generate minute currents in the strings 30, 32, 34, and 36 as they vibrate during play. These minute electrical signals are delivered to the preamplifiers 70, 72, 74, and 76 via the cable 82.

Alternatively, the guitar 10 may be wired in reverse so that the strings are grounded at the tuning pegs, passed over insulating saddles on the bridge and connected at an insulated string anchor. In the configuration shown in FIG. 1, the presence of a shielded cable 82 having a grounded outer shield running adjacently parallel to the strings 30, 32, 34 and 36 tends to reduce pickup of stray fields and signals, and is, therefore, a preferred connection configuration.

In the preamplifiers 70, 72, 74, and 76, the low input impedances are accommodated, and the induced minute signals are amplified, total preamplifier gain approximates 5000. This high gain is achieved by using two amplifying elements connected in tandem. The first amplifying element may be the same as the electrical equivalent of the low noise amplifier described in U.S. Pat. No. 4,035,737 to John J. Curl. This amplifier provides a very low impedance input and an output gain of approximately 50 along with an impedance transformation to a substantially higher output impedance. The output of the Curl preamplifier may be provided to an input of an operational audio amplifier such as Type LF-356N manufactured by National Semiconductor. The amplifiers may include gain and frequency equalization elements and controls in conventional manner. The summing amplifier 78 may be one more integrated circuit type LF356N manufactured by National Semiconductor. Suitable electrical supply signals are provided to the amplifiers 70, 72, 74, 76, 78 from the batteries 86 and 88, and the amplifiers are biased for proper operating point and desired gain in conventional manner.

It is to be understood that the configuration of magnets, strings and circuitry as shown in FIGS. 1, 2 and 3, a fretless electrical bass guitar 10 is provided which closely emulates the sounds of a plucked, stringed acoustical bass instrument. Yet, with a rearrangement of the magnets in the vault 46, the guitar 10 may be provided with a distinctly different amplified tonal characteristic, e.g., with percussion overtones predominating.

The magnet 56 is provided to generate a field adjacent the strings 34 and 36 in order to provide constant output over the tone spectrum of each string. Without the magnet 56 it was learned that the signal output from the lowest note string 36 fell off at the higher frequencies while the output of the next lowest note string 34 lacked linearity. Through experimentation with the magnets, and subjective evaluation of amplified tonal characteristics by the artist, it is found that the addition of the magnet 56 improves the overall tonal quality and evenness of amplitude of the guitar 10. It is to be emphasized that with the present invention as embodied, for example, in the guitar 10, the artist is able to control the tonal quality of the guitar to match personal standards and tastes in a way that was heretofore not possible with conventional electronic equalization techniques.

Another embodiment of the present invention is found in the acoustical guitar 110 illustrated in FIGS. 4, 5, 6 and 7. Therein, the acoustical guitar 110 is seen to have the conventional elements of a sounding board 112, side walls 114, bottom plate 116 which form the sound box and provide an interior space 118 through which sound passes from the strings at an opening 120 in the sounding board 112. String anchor pegs 122 and a bridge 124 serve to anchor and guide six metallic strings at one end. The guitar 110 includes a neck 126 having a fretted finger board 128 with metallic frets 130 embedded therein which extends out to a tuning peg head 156 shown in FIG. 5. The six conductive strings 132, 134, 136, 138, 140, 142 are suspended under tension between the anchors 122 and tuning pegs 144, 146, 148, 150, 152, 154 at the neck 156, as shown in FIG. 5. The electrically conductive strings are connected together into three interleaved pairs by conductive fittings 158, 160, 162 which are fitted over the tuning pegs, as shown in FIG. 5. These straps may be structured in an artistic pattern and added to the guitar to provide the modification required to provide the present invention. Alternatively, conductive tuning pegs may be employed with interconnecting wires, similar to the peg 24 shown in FIG. 8 and already described.

At the end of the finger board 128 closest to the sound box opening 120, a rectangular bar magnet 164, made of a ferroceramic material and with a pole aligned to the strings, is provided as shown in FIGS. 4 and 6. Another ferroceramic magnet 166, preferably having a flat, trapezoidal geometry, is affixed, as with glue, within the sound box to the backside of the sounding board directly underneath the magnet 164 in an orientation in which its poles are in alignment with the poles of the magnet 164. The fields provided by the magnet 166 add to the fields provided by the magnet 164. Consequently, the high note string 132 is provided with the strongest magnetic field while the low note string 142 is provided with the weakest magnetic field. The reason for the differential in magnetic field strength for each string is that the lower strings vibrate more slowly but with a greater physical displacement, which means that they cut more lines of force than do the high note strings which vibrate very rapidly but are displaced very little distance during vibration. With a field tailored to each string, as with the combination of magnets 164 and 166, a substantially uniform electrical analog signal is induced in the strings during play.

The string pairs are connected in parallel at the anchor pins 122 as shown in the schematic circuit diagram of FIG. 7. A cable 168 connects to the paralleled pairs of strings at the anchor pegs 122 and extends to a jack 170 having an outer annular flange which doubly functions as a strap anchor. The jack 170 accommodates the plug on an extension cable 172 which leads to an outboard preamplifier 174 which may be equivalent to one of the preamplifiers 70, 72, 74, 76 already described.

While the preamplifier 174 works fairly well for the guitar 110, a further substantial improvement in quality is achieved by the use of an impedance balancing moving coil input transformer 176 ahead of the amplifier 174, as shown in FIG. 7-A. The transformer 176 is preferably a Jenson type JE-34K-DX moving coil transformer or equivalent with a low impedance winding connected to the strings via the cable 168, jack 170, extension line 172 connection arrangement. The preamplifier 174 provides a suitable output to other amplification and loudspeaker equipment which is conventional and not a part of the present invention.

It is to be understood that only two magnets 164 and 166 are illustrated in connection with the guitar 110. Other magnets may be included in the sound box in orientations and strengths which accommodate the characteristics of the particular artist, strings or manner of play whether by individual string plucking or strumming. The magnets may be fixed in place or readjustable by the artist. In any event, the magnetic field for each string will be different, in accordance with the principles of the present invention.

To those skilled in the art to which this invention relates, many changes in construction and widely differing embodiments and applications of the invention will suggest themselves without departing from the spirit and scope of the invention. The disclosure and the description herein are purely illustrative and are not intended to be in any sense limiting.

I claim:

1. In a stringed musical instrument having a frame with a plurality of electrically conductive strings adapted and tuned under tension to different tonal frequencies between electrically isolated anchors thereon, to be played in conjunction with a loudspeaker system for increasing the sound level of said musical instrument, an improved electromagnetic pickup at said instrument and connected to said loudspeaker system, said pickup comprising:

constant magnetic field providing means aligned adjacent to each of said plurality of strings at a sound providing region of said frame for generating a magnetic flux strength and orientation uniquely adjustable by the musician to each particular string to transduce into an electrical analog signal its desired tonal characteristics, electrical connector means for connecting to said strings at their anchors, very high gain preamplifier means having very low impedance input connected from said strings through said connector means and output connected to said loudspeaker system, for amplifying greatly the minute electrical signals induced in said plurality of electrically conductive strings when the instrument is being played.

2. In a stringed musical instrument having a frame with a plurality of electrically conductive strings adaped and tuned under tension to different tonal frequencies between electrically isolated anchors thereon, to be used in conjunction with a loudspeaker system for increasing the sound level of said musical instrument, an improved electromagnetic pickup at said instrument and connected to said loudspeaker system, said pickup comprising:

a plurality of discrete magnets, each movably aligned by the player within a magnet vault adjacent to the said plurality of strings at a sound providing region of said frame, for generating in combination a magnetic flux strength and orientation for each string adjusted to the particular string and its desired tonal characteristics as said instrument is played, electrical connector means in said frame for connecting to said strings at their anchors, very high gain preamplifier means having very low impedance input connected from said strings through said connector means and output connected to said loudspeaker system, for amplifying greatly the minute electrical signals induced in said plurality of electrically conductive strings when the instrument is being played.

3. In a stringed musical instrument having a frame with a plurality of electrically conductive strings adapted and tuned under tension to different tonal frequencies between electrically isolated anchors thereon, to be used in conjunction with a loudspeaker system for increasing the sound level of said musical instrument, an improved electromagnetic pickup at said instrument and connected to said loudspeaker system, said pickup comprising:

a plurality of discrete magnets, each having a magnetic pole region laterally alignable by the musician adjacent to one of said plurality of strings at a sound providing region of said frame, for generating a magnetic flux strength and orientation for each string adjusted to the particular string and its desired tonal characteristics, electrical connector means in said frame for connecting to said strings at their anchors, very high gain amplifier means having very low impedance input connected from said strings through said connector means and output connected to said loudspeaker system, for amplifying greatly the minute electrical signals induced in said plurality of electrically conductive strings when the instrument is being played.

4. In a stringed musical instrument having a frame with a plurality of electrically conductive strings adapted and tuned under tension to different tonal frequencies between electrically isolated anchors thereon, to be used in conjunction with a loudspeaker system for increasing the sound level of said musical instrument, an improved electromagnetic pickup at said instrument and connected to said loudspeaker system, said pickup comprising:

a plurality of discrete magnets each laterally adjustable within a vault adjacent to said plurality of strings at a sound providing region of said frame, for generating a magnetic flux strength and orientation for each string adjusted by the musician to the particular string and its tonal characteristics, said frame including magnet holder means in said vault for holding said magnets in place during play and for providing access thereto so that they may be rearranged to alter tonal characteristics of a string as reproduced by said loudspeaker system, electrical connector means in said frame for connecting to said strings at their anchors, very high gain preamplifier means having very low impedance input connected from said strings through said connector means and output connected to said loudspeaker system, for amplifying greatly the minute electrical signals induced in said plurality of electrically conductive strings when the instruments is being played.

5. In a stringed musical instrument having a frame with a plurality of electrically conductive strings adapted and tuned under tension to different tonal frequencies between electrically isolated anchors thereon, used in conjunction with a loudspeaker system for increasing the sound level of said musical instrument, an improved electromagnetic pickup at said instrument and connected to said loudspeaker system, said pickup comprising:

constant magnetic field providing means aligned adjacent to each of said plurality of strings at a sound providing region of said frame, for generating a magnetic flux strength and orientation for each string adjustable to the particular string and its tonal characteristics, and wherein said flux strength increases as the tonal frequency of each string increases, electrical connector means in said frame for connecting to said strings at their anchors, very high gain preamplifier means having very low impedance input connected from said strings through said connector means and output connected to said loudspeaker system, for amplifying greatly the minute electrical signals induced in said plurality of electrically conductive strings when the instrument is being played.

6. In a stringed musical instrument having a frame with a plurality of electrically conductive strings adapted and tuned under tension to different tonal frequencies between electrically isolated anchors thereon, used in conjunction with a loudspeaker system for increasing the sound level of said musical instrument, an improved electromagnetic pickup at said instrument and connected to said loudspeaker system, said pickup comprising:

constant magnetic field providing means and having a magnetic pole region aligned adjacent to each of said plurality of strings at a sound providing region of said frame, for generating a magnetic flux strength and orientation for each string adjustable to the particular string and its tonal characteristics, and wherein said flux strength increases as the tonal frequency of each string increases, electrical connector means in said frame for connecting to said strings at their anchors, very high gain preamplifier means having very low impedance input connected from said strings through said connector means and output connected to said loudspeaker system, for amplifying greatly the minute electrical signals induced in said plurality of electrically conductive strings when the instrument is being played.

7. In a stringed musical instrument having a frame with a plurality of electrically conductive strings adapted and tuned under tension to different tonal frequencies between a connection and securement means at one end thereof and electrically isolated anchors at the other end thereof to be used in conjunction with a loudspeaker system for increasing the sound level of said musical instrument, an improved electromagnetic pickup at said instrument and connected to said loudspeaker system, said pickup comprising:

constant magnetic field providing means aligned adjacent to each of said plurality of strings at a sound providing region of said frame, for generating a magnetic flux strength and orientation for each string adjustable by the musician to the particular string and its desired tonal characteristics, electrical connector means in said frame for connecting adjacent pairs of said strings in series at one end thereof and in parallel at the other end thereof, a very high gain preamplifier having a very low impedance input connected across said parallel connected end of string pairs and an output connected to said loudspeaker system, for amplifying greatly the minute electrical signals induced in said strings when the instrument is being played.

8. In a stringed musical instrument having a frame with a plurality of electrically conductive strings adapted and tuned under tension to different tonal frequencies between a connection and securement means at one end thereof and electrically isolated anchors at the other end thereof to be used in conjunction with a loudspeaker system for increasing the sound level of said musical instrument, an improved electromagnetic pickup at said instrument and connected to said loudspeaker system, said pickup comprising:

constant magnetic field providing means aligned adjacent to each of said plurality of strings at a sound providing region of said frame, for generating a magnetic flux strength and orientation for each string adjustable to the particular string and its tonal characteristics, and wherein said flux strength increases as the tonal frequency of each string increases, electrical connector means in said frame for connecting adjacent pairs of said strings in series at one end thereof and is parallel at the other end thereof, a very high gain preamplifier having a very low impedance input connected across said parallel connected end of string pairs and an output connected to said loudspeaker system, for amplifying greatly the minute electrical signals induced in said strings when the instrument is being played.

* * * * *